US011703187B2

(12) United States Patent
Ragot

(10) Patent No.: US 11,703,187 B2
(45) Date of Patent: Jul. 18, 2023

(54) METHOD FOR PROVIDING PRESSURIZED GAS TO CONSUMERS AND CORRESPONDING COMPRESSOR ARRANGEMENT AT VARIABLE SUCTION CONDITIONS

(71) Applicant: Cryostar SAS, Hesingue Grand Est (FR)

(72) Inventor: Mathias Ragot, Sierentz (FR)

(73) Assignee: Cryostar SAS, Hesingue (FR)

( * ) Notice: Subject to any disclaimer, the term of this patent is extended or adjusted under 35 U.S.C. 154(b) by 224 days.

(21) Appl. No.: 16/959,474

(22) PCT Filed: Dec. 12, 2018

(86) PCT No.: PCT/EP2018/084527

§ 371 (c)(1),
(2) Date: Jul. 1, 2020

(87) PCT Pub. No.: WO2019/134799

PCT Pub. Date: Jul. 11, 2019

(65) Prior Publication Data

US 2021/0071815 A1 Mar. 11, 2021

(30) Foreign Application Priority Data

Jan. 8, 2018 (EP) ..... 18305009

(51) Int. Cl.
*F17C 7/04* (2006.01)

(52) U.S. Cl.
CPC ..... *F17C 7/04* (2013.01); *F17C 2221/033* (2013.01); *F17C 2223/0161* (2013.01);
(Continued)

(58) Field of Classification Search
CPC ..... F17C 2221/033; F17C 2223/0161; F17C 2223/033; F17C 2225/0123;
(Continued)

(56) References Cited

U.S. PATENT DOCUMENTS

2014/0075943 A1 3/2014 Jung et al.
2015/0285189 A1 10/2015 Lee et al.
(Continued)

FOREIGN PATENT DOCUMENTS

EP 3 159 637 A2 4/2017
JP 2016 505784 A 2/2016
(Continued)

OTHER PUBLICATIONS

WO2017209492A1 (English Translation) (Year: 2017).*
International Search Report of the International Searching Authority for PCT/EP2018/084527 dated Apr. 30, 2019.

*Primary Examiner* — Timothy P. Kelly
*Assistant Examiner* — Christopher M Afful
(74) *Attorney, Agent, or Firm* — Millen White Zelano & Branigan, PC; Brion P. Heaney

(57) ABSTRACT

The invention relates to a method for providing pressurized gas from a source of liquefied gas to a consumer (8), wherein vaporized gas is supplied from the source of liquefied gas (1) through a main input line (2) to a compressor arrangement (300) for pressurizing the vaporized gas, the compressor arrangement (300) comprising a plurality of compressor modules (3, 5, 31, 51), each compressor module being able to operate independently from any other compressor module of the compressor arrangement (300), one or more of the compressor modules (5, 51) of the compressor arrangement (300) can be bypassed, and wherein gas is conducted through only a part or all of the compressor modules depending on at least one of pressure level, temperature level, mass flow and composition of the gas to be provided to the consumer (8).

23 Claims, 8 Drawing Sheets

(52) U.S. Cl.
CPC ..... *F17C 2223/033* (2013.01); *F17C 2225/0123* (2013.01); *F17C 2227/0157* (2013.01); *F17C 2227/0185* (2013.01); *F17C 2227/0337* (2013.01); *F17C 2250/043* (2013.01); *F17C 2250/0439* (2013.01); *F17C 2250/0443* (2013.01); *F17C 2250/0447* (2013.01); *F17C 2265/03* (2013.01)

(58) Field of Classification Search
CPC ..... F17C 2227/0157; F17C 2227/0185; F17C 2227/0337; F17C 2250/043; F17C 2250/0439; F17C 2250/0443; F17C 2250/0447; F17C 2265/03
USPC ..... 62/50.2
See application file for complete search history.

(56) References Cited

U.S. PATENT DOCUMENTS

| | | | | |
|---|---|---|---|---|
| 2015/0330574 | A1 | 11/2015 | Fuchs et al. | |
| 2016/0060038 | A1* | 3/2016 | Oates | C01B 3/00 62/515 |
| 2017/0089637 | A1 | 3/2017 | Wehrman et al. | |
| 2018/0201353 | A1 | 7/2018 | Lee et al. | |

FOREIGN PATENT DOCUMENTS

| | | | | |
|---|---|---|---|---|
| KR | 101 613 236 | B1 | 4/2016 | |
| KR | 101 644 386 | B1 | 8/2016 | |
| KR | 2016 0120188 | A | 10/2016 | |
| WO | WO-2017209492 | A1 * | 12/2017 | B63B 25/16 |

* cited by examiner

METHOD FOR PROVIDING PRESSURIZED GAS TO CONSUMERS AND CORRESPONDING COMPRESSOR ARRANGEMENT AT VARIABLE SUCTION CONDITIONS

The present invention relates to a method for providing pressurized gas from a source of liquefied gas to a consumer and a corresponding compressor arrangement at variable suction conditions. It is of particular reference and benefit to the supply of fuel gas from a source of liquefied gas.

The invention is of particular relevance to the supply of fuel gas from a source of liquefied natural gas (LNG), especially in ocean-going tankers and is primarily described herein with the reference to this application. It is, however, to be understood that it is also applicable to other cryogenic liquids or liquid mixtures.

STATE OF THE ART

While natural gas is conveniently stored and transported in liquid state, it is generally used, however, in the gaseous state, e. g. for propulsion of the tanker. To this end, a flow of LNG can be vaporized and/or boil-off gas, i. e. evaporated LNG from the ullage space of the container can be used. Such vaporized gas is supplied from the source of liquefied gas through a main input line to a compressor for pressurizing the vaporized gas. Over the past decades, fuel gas supply to LNG carrier propulsion has namely being achieved using multi-stage compressors (stage number ranging from 2 to 6 stages), in which typically each stage is integrated in one single gear box including several high speed shafts. For example, 4-stage compressors have progressively replaced 2-stage compressors for DFDE (Dual Fuel Diesel Electric) 4-stroke propulsion, since 4-stage compressors are able to maintain the required fuel gas (FG) pressure (6 bara) even with warm boil off gas (BOG) at suction. Recently, 6-stage compressors have been developed to cope with 2-stroke dual fuel propulsion requirements for 17 bara fuel gas pressure level (XDF). A 2-stage compressor is mainly used in laden voyage when BOG is cold (typically −90° C.). However, when the BOG temperature warms-up (especially during ballast voyage), performance limitations are reached and it becomes difficult to maintain the required fuel gas pressure. 4-stage compressors can be used either in cold (laden) or in warm (ballast and heel-out) BOG conditions. Thus, different BOG conditions (laden, ballast or heel-out) and different consumers (2 or 4-stroke dual fuel engines) require different multi-stage compressors leading to a cumbersome and costly compressor arrangement.

Very often, a standard approach selected during ship design is to provide one fuel gas (FG) compressor (with a spare one) sized to supply gas to the consumers with the most constraining suction conditions. At fixed discharge pressure dictated by the FG consumer, the variability of suction conditions (pressure, temperature and composition) can lead to a FG compressor design which is not optimized in all possible operating cases.

Typical temperature levels met at compressor suction are ranging from 40° C. to −140° C. (covering heel-out to laden operations) which has a great impact on fuel gas density. The compressor design features required to cope with this fuel gas density range often leads to a lower compressor efficiency at cold temperature. This is due to the fact that, in cold suction conditions, the required head of the overall compressor is lower. The technical term "compressor head" basically corresponds to the pressure of the pressurized fluid, more specifically to the pressure divided by the product of fluid density and the gravitation constant. This corresponds to the height of a column of the fluid excerting said pressure on its bottom.

Typical FG compressor suction pressure levels met on LNG carriers are ranging from 1.03 to 1.7 bara which has even a greater impact on compressor performance than the suction temperature range. At fixed discharge pressure, the poorest performances are met at high suction pressure since it leads to a lower required head of the compressor. Often low temperature and high pressure conditions at compressor suction are combined.

Variable frequency drive of the compressor engine could be foreseen to optimize the compressor head and the efficiency thanks to driver speed adjustment. However, the drawback of this solution is the effect on compressor flow. It is not always possible to maintain compressor mass flow (required by FG consumers) when the required head is decreased. Moreover, as most of the FG compressors implemented on LNG carriers are integrally geared machines, by decreasing machine speed, you can reach critical speed levels which are not suitable for the machine mechanical integrity.

The typical composition of BOG is ranging from pure methane to a C1/N2 mixture containing up to 20% mol N2. BOG from the tanks is usually found in the range of 40/−140° C. 40° C. BOG is met when the tanks are operated with very few liquid (dead heel). −140° C. is often met after tank loading when BOG flow is high. Intermediate temperature levels (−50/−80° C.) can be found in ballast operations. The pressure ranges from 1.03 to 1.7 bara. Typical LNG carriers have tank operating pressure levels ranging from 1.03 to 1.26 bara whereas vessels with reinforced tank containments have operating pressures reaching 1.6 bara or slightly above.

LP (Low Pressure) consumers usually require FG at around 6 bara and 20/40° C. MP (Medium Pressure) consumers usually require FG at a pressure levels of 15 and 40 bara and 20/40° C. HP (High Pressure) consumers usually require FG at a pressure above 100 bar (up to 400 bara) and a temperature range 40/20° C.

It is therefore an object of the present invention to provide an efficient method for providing pressurized gas from a source of liquefied gas to a consumer, especially providing the possibility of using vaporized gas of different temperature and/or pressure and/or mass flow levels and/or of varying composition and/or supplying different consumers requiring pressurized gas at different temperature and/or pressure levels, with pressurized gas, especially with fuel gas from an LNG source.

SUMMARY OF THE PRESENT INVENTION

According to the present invention there is provided a method for supplying pressurized gas from a source of liquefied gas to a consumer, wherein vaporized gas is supplied from the source of liquefied gas through a main input line to a compressor arrangement for pressurizing the vaporized gas and a corresponding compressor arrangement according to the independent claims. Preferred embodiments are given in the respective dependent claims and the following description.

According to the present invention there is provided a method for supplying pressurized gas from a source of liquefied gas to a consumer, wherein vaporized gas is supplied from the source of liquefied gas through a main input line to a compressor arrangement for pressurizing the vaporized gas, wherein the compressor arrangement comprises a plurality of compressor modules, each compressor module being able to operate independently from any other compressor module of the compressor arrangement, and wherein one or more of the compressor modules of the compressor arrangement can be bypassed, and wherein depending on at least one of pressure level, temperature level, mass flow and composition of the gas to be provided to the consumer, gas is conducted through only a part or through all of the compressor modules.

The term "vaporized gas is supplied from the source of liquefied gas" is primarily to be understood as withdrawing evaporated gas from the ullage space of the container/source of liquefied gas where the stored liquefied gas changes its stage from liquid to vapor. It is, however, also possible to withdraw a flow of liquefied gas and to vaporize the liquefied gas in order to supply such vaporized gas to the compressor arrangement.

The term "compressor module" is to be understood as a compressor skid including one or a plurality of compressor stages mounted on one or a plurality of mechanical shafts. The present invention can be applied to different types of compressor technology including integrally geared centrifugal compressors, piston or screw compressors or magnetic bearing type compressors. It can be envisaged to equip each or all of the centrifugal compressor stages with variable diffusor vanes (VDV) to cope with the range of suction conditions at the inlet of each compressor stage. Inter-stage or after coolers can be implemented either inside a compressor module or outside a compressor module. Several independently operable modules can be installed in series and/or in parallel. The possibility of bypassing one or more of the compressor modules of the compressor arrangement allows for a flexible operation depending on the suction conditions to reach the required gas pressure level. At the same time, it is possible to deactivate compressor modules which are presently not needed. Furthermore, the compressor arrangement according to the present invention allows for spare compressor modules.

The proposed approach according to the present invention is to provide a modular compressor train philosophy with a limited footprint. Compressor efficiency is maintained over the whole range of suction conditions. Optimization of (fuel) gas compressor efficiency is achieved by selecting the numbers of compressor modules put in operation according to the required load (mass flow), pressure level head and/or temperature of the gas which is provided to the consumer.

In a preferred embodiment, at least a part of the compressor modules is connected in series and one or more of the bypassed compressor modules are deactivated. For example, two 2-stage compressor modules are connected in series. The second (or the first) compressor module can be bypassed via a bypass line. With such a compressor train modularization, it is not necessary to run a 4-stage compressor when only two stages are required, since the second (or the first) compressor module can be bypassed in this case. As an example, the first compressor module of two stages could be operated only in cold suction conditions whereas the additional second compressor module could be started in case of warm suction conditions in order to maintain the required fuel gas pressure. This is an improvement in terms of power consumption of the compressor arrangement.

In another preferred embodiment, at least a part of the compressor modules is arranged in parallel. It should be noted that this embodiment includes the possibility of parallel trains of compressor modules, each train comprising one or more compressor modules connected in series. In such a parallel arrangement, an easy way of bypassing one or more compressor modules is to shut-off a train of compressor modules e. g. by means of a shut-off valve.

Operating parallel trains of compressor modules is especially advantageous in case of high load requirements. Bypassing or shutting-off one or more of said parallel trains allows to cope with different load levels.

In order to increase flexibility of operating compressor modules arranged in parallel, specific compressor modules of parallel trains can be connected via crossover-lines in order to allow an operation of such connected compressor modules in series. To this end, a first compressor module and a second compressor module which are arranged in parallel (in parallel trains) are connected via a crossover-line which can be shut-off and which connects an outlet of the first compressor module with an inlet of the second compressor module. When the crossover-line is in an open state (open shut-off valve) a gas can be conducted through the first and the second compressor modules which are then operated in series. This embodiment allows to operate specific compressor modules of parallel trains of one or more compressor modules connected in series, in series by interconnecting the specific compressor modules via crossover-lines having shut-off valves.

The preferred application of the present invention is supplying fuel gas from a LNG source to different pressure level consumers. Preferably, boil-off gas (BOG) from the source of liquefied gas is used as the vaporized gas which is supplied to the compressor arrangement.

Preferably, pressurized gas is cooled by conducting the gas through a first cooling unit in a bypass line bypassing the one or more compressor modules. As an example, if the first compressor module is only operated in cold suction conditions, the pressurized gas exiting the first compressor module can be cooled further down by the first cooling unit which is arranged in the bypass line bypassing the second compressor module.

Additionally or alternatively, pressurized gas is cooled by conducting the gas through a second cooling unit arranged at the inlet of a specific compressor module and/or by conducting the gas through a third cooling unit arranged at the outlet of this or another compressor module. This option is especially preferred when using two (or more) compressor modules in series in order to be able to precool or aftercool the gas at the inlet and at the outlet of the subsequent compressor module, respectively.

In another preferred embodiment, at least a part of the pressurized gas of a compressor module is returned to the inlet of the compressor module via an antisurge line. Antisurge lines as such are known in the prior art and operate such that always a given minimum volume of gas is input at the entrance of a compressor module. Such an antisurge line can be part of a compressor module. In a preferred embodiment, however, before returning the gas to the inlet of the compressor module, the gas is cooled by a fourth cooling unit at the outlet of the compressor module. In this case the antisurge line is branched-off at the outlet of the fourth cooling unit and conducts cooled gas back to the inlet of the compressor module. The fourth cooling unit can be provided at the outlet of the compressor module; on the other hand, it is also possible to make the fourth cooling unit part of the compressor module. Assuming that the compressor module having said antisurge line is bypassed by a bypass line, there are two options of bypassing. The bypassed gas can be fed-in into the header leading to the consumer, downstream of the fourth cooling unit and of the branch point of the antisurge line. It is, however, also possible to feed-in the bypassed gas upstream of the fourth cooling unit such that the fourth cooling unit operates as an aftercooler for the bypassed gas. Such an arrangement allows operation of the fourth cooling unit as an aftercooler both when the corresponding compressor module is bypassed and when the corresponding compressor module is actually used.

According to a second aspect, the present invention relates to a compressor arrangement for providing pressurized gas from a source of liquefied gas to a consumer.

The compressor arrangement according to the second aspect of the present invention comprises a plurality of compressor modules, each compressor module being able to operate independently from any other compressor module of the compressor arrangement, wherein the compressor modules of the compressor arrangement are arranged such that one or more of the compressor modules of the compressor arrangement can be bypassed, such that gas is conducted through only a part or all of the compressor modules via a consumer line to the consumer.

According to a preferred embodiment, the compressor arrangement comprises at least two compressor modules connected in series by interconnection lines, wherein a bypass line branches off upstream an inlet of one of the compressor modules and reconnects downstream an outlet of this or another compressor module, the bypass line having a shut-off device to be operated depending on at least one of pressure level, temperature level, mass flow and composition of the gas to be provided to the consumer.

In another preferred embodiment, the compressor arrangement comprises at least two parallel trains of compressor modules, each train being connectable to the main input line each train comprising one or more compressor modules, wherein an outlet of one compressor module of one of the at least two parallel trains is connected with an inlet of another compressor module of another train of the at least two parallel trains via a crossover-line, the crossover-line having a shut-off device to be operated depending on at least one of pressure level, temperature level, mass flow and composition of the gas to be provided to the consumer.

Preferably, the bypass line reconnects to the consumer line upstream of a fourth cooling unit.

In another preferred embodiment, a compressor module comprises at least a part of an antisurge line for returning at least a part of the pressurized gas of the compressor module to an inlet of this compressor module, a cooling unit being arranged at the outlet of the compressor module, and the inlet of the antisurge line is located downstream of the cooling unit such that an inlet part of the antisurge line is located outside of the compressor module.

Regarding further explanations as to the advantages of the compressor arrangement and its embodiments reference is explicitly made to the statements in connection with the method according to the present invention above.

Further advantages and preferred embodiments of the invention are disclosed in the following description and figures.

It is understood by a person skilled in the art that the preceding and the following features are not only disclosed in the detailed combinations as discussed or showed in a figure, but that also other combinations of the features can be used without exceeding the scope of the present invention.

The invention will now be further described with reference to the accompanying drawings showing preferred embodiments.

DETAILED DESCRIPTION OF THE DRAWINGS

In the following, the different embodiments according to the Figures are discussed comprehensively, same reference signs indicating same or essentially same units. It is appreciated that a person skilled in the art may combine certain components like one or more compressor modules, a valve, a cooling unit, certain lines etc. of an embodiment shown in a figure with the features of the present invention as defined in the appended claims without the need to include more than this certain component or even all other components of this embodiment shown in said figure. In other words, the following figures show different preferable aspects of the present invention, which can be combined to other embodiments. The embodiments shown in the figures all relate to the application of supplying fuel gas from an LNG source, but it is appreciated that a person skilled in the art can easily transfer the embodiments to applications involving other cryogenic gases or gas mixtures.

Figure 1A:
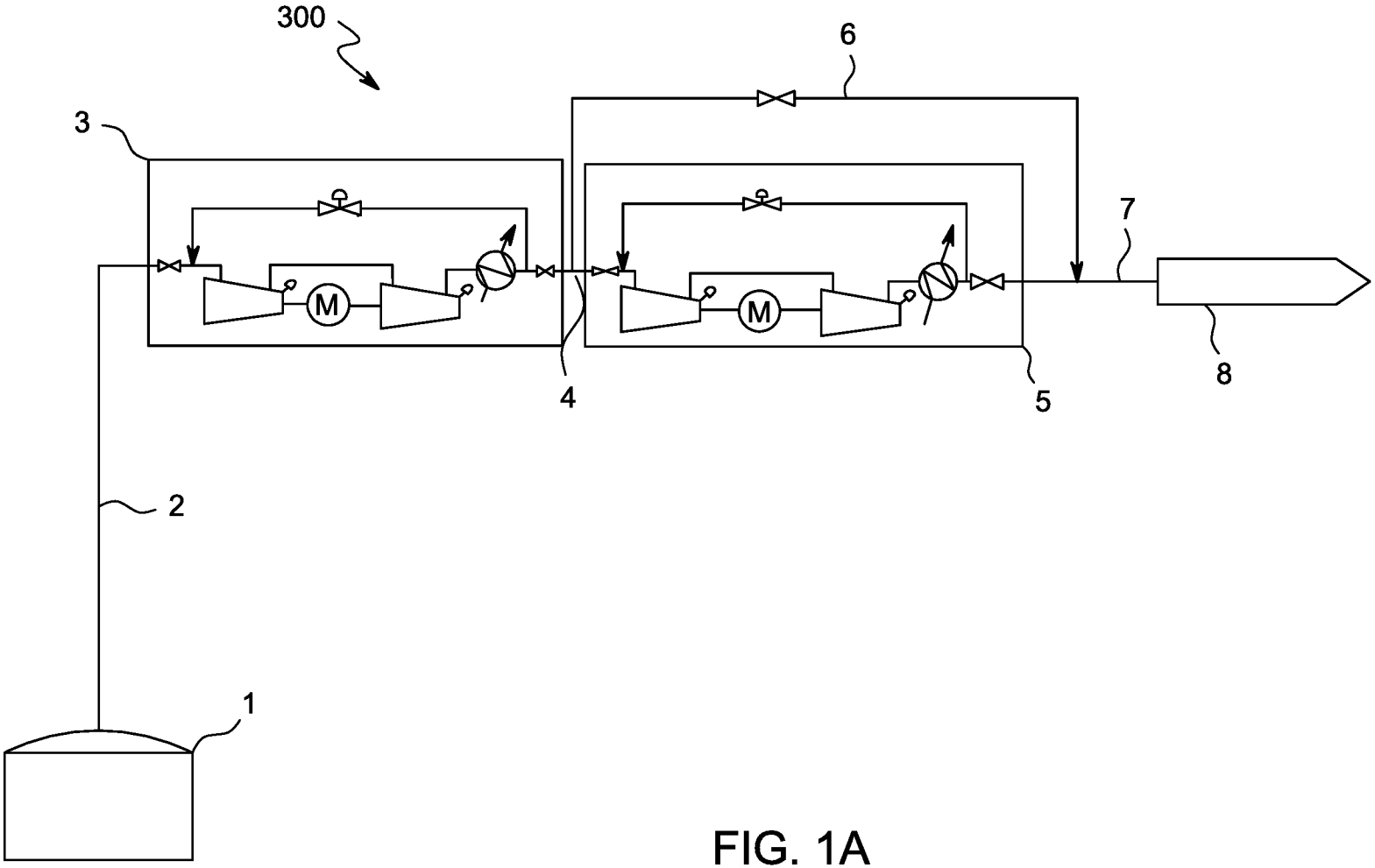
FIG. 1A schematically shows a first embodiment of a compressor arrangement for implementing the method according to the present invention FIG. 1B schematically shows a second embodiment of a compressor arrangement for implementing the method according to the present invention FIG. 1C schematically shows a third embodiment of a compressor arrangement for implementing the method according to the present invention FIG. 1D schematically shows a fourth embodiment of a compressor arrangement for implementing the method according to the present invention FIG. 1E schematically shows a fifth embodiment of a compressor arrangement for implementing the method according to the present invention FIG. 2A schematically shows a sixth embodiment of a compressor arrangement for implementing the method according to the present invention FIG. 2B schematically shows a seventh embodiment of a compressor arrangement for implementing the method according to the present invention FIG. 3 schematically shows an eight embodiment of a compressor arrangement for implementing the method according to the present invention.

FIG. 1A schematically shows a compressor arrangement 300 for providing pressurized gas from a tank 1 or source of liquefied gas to a consumer 8, wherein vaporized gas, in this case BOG, is supplied from the tank 1 through a main input line 2 to the compressor arrangement 300. In this embodiment, the compressor arrangement 300 comprises two compressor modules 3 and 5, both being 2-stage compressors. Each of the compressor modules 3, 5 includes all equipment, valves and instruments as an independent compressor system. Compressor module 3 is able to operate independently from compressor module 5, same is true vice versa. Instead of a 2-stage compressor 3, 5, any other multi- or single-stage compressor can be used. Further, it should be noted that also more than two compressor modules can be connected in series, in that case one, two or more compressor modules can be bypassed. In the present embodiment, bypass line 6 bypasses the second compressor module 5. The bypass line 6 branches off of the interconnecting line 4 connecting the two compressor modules 3 and 5, and ends in the header 7, i. e. the consumer line for supplying fuel gas to a consumer 8.

When overall fuel gas system process conditions require low compressor head, typically low temperature (−120/−60° C.) and relatively high pressure (1.2/1.5 bar), it is preferable to run compressor module 3 only and bypass compressor module 5 which is then preferably deactivated. Fuel gas is conveyed to the consumer 8 after having been pressurized by compressor module 3 through bypass line 6 and header 7. When overall fuel gas system process conditions require high compressor head, typically high suction temperature (−60/40° C.) and relatively low suction pressure (<1.1 bar), both modules 3 and 5 can operate simultaneously such that fuel gas is pressurized by both compressor modules 3 and 5 and then conducted through header 7 to consumer 8.

When the compressor head required by the fuel gas system exceeds the capability of module 3, an automatic line-up of module 5 is provided. This can be achieved by a sequential control combining module 5 start-up, closure of bypass line 6 (i.e. module bypass control valve) and compressor load-up.

Figure 1B:
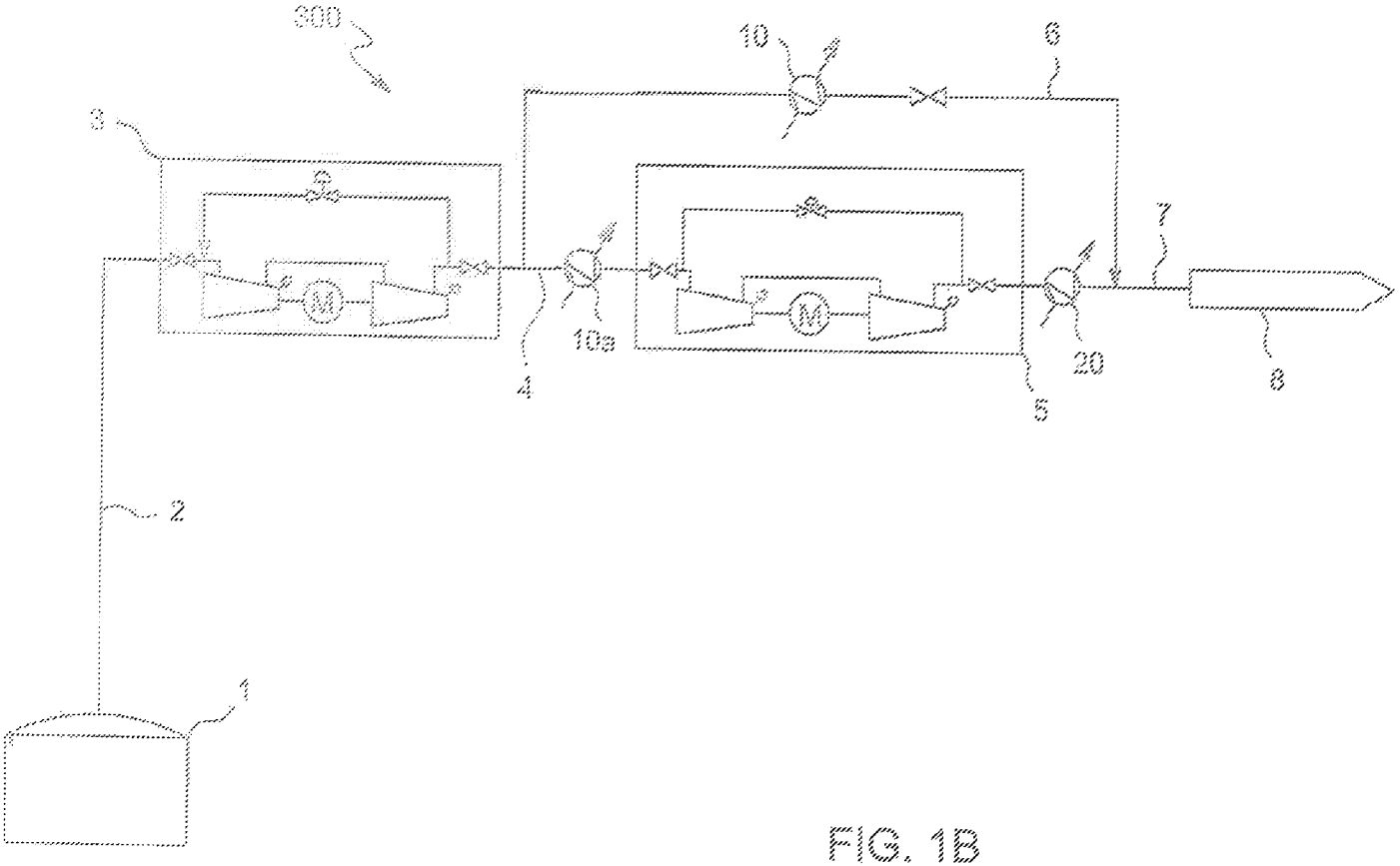

FIG. 1B shows another embodiment of a compressor arrangement 300 for the same purpose as in FIG. 1A. The arrangement essentially corresponds to that of FIG. 1A such that only the differences are discussed in the following. The bypass line 6 comprises a cooling unit 10 (first cooling unit) for cooling gas which is pressurized by compressor module 3 and bypassing compressor module 5. The pressurized and cooled bypassed fuel gas is then conveyed through header 7 to consumer 8. When both compressor modules 3 and 5 are used, pressurized gas is cooled by another cooling unit 20 (third cooling unit). The cooled pressurized fuel gas is then sent via header 7 to consumer 8. Optionally, another cooling unit 10*a* (second cooling unit) can be arranged at the entrance of the second compressor module 5 in the interconnecting line 4. If the second cooling unit 10*a* is arranged downstream the branch point of the bypass line 6, only gas entering the second compressor module 5 is cooled. However, if the second cooling unit is arranged upstream the branch point (not shown) of the bypass line 6, both gas entering the bypass line 6 and gas entering the second compressor module 5 can be cooled. In the latter case, the gas cooler 10 in the bypass line 6 could be saved.

FIG. 10 schematically shows another embodiment of compressor arrangement similar to the one of FIG. 1B with the main difference that the antisurge line 9 of compressor module 5 is not completely integrated into module 5. As known to a person skilled in the art, compressors may have an antisurge line having a flow regulating valve such that always a given volume of gas enters the compressor. In FIG. 10 the antisurge line 9 of compressor module 5 branches off the header 7 downstream of cooling unit 30 (fourth cooling unit, same as third cooling unit 20 of FIG. 1B) such that cooled compressed gas exiting the second compressor module 5 is returned back to an inlet of compressor module 5. This results in a more economic utilization of the compressor capacity of module 5.

Figure 1C:
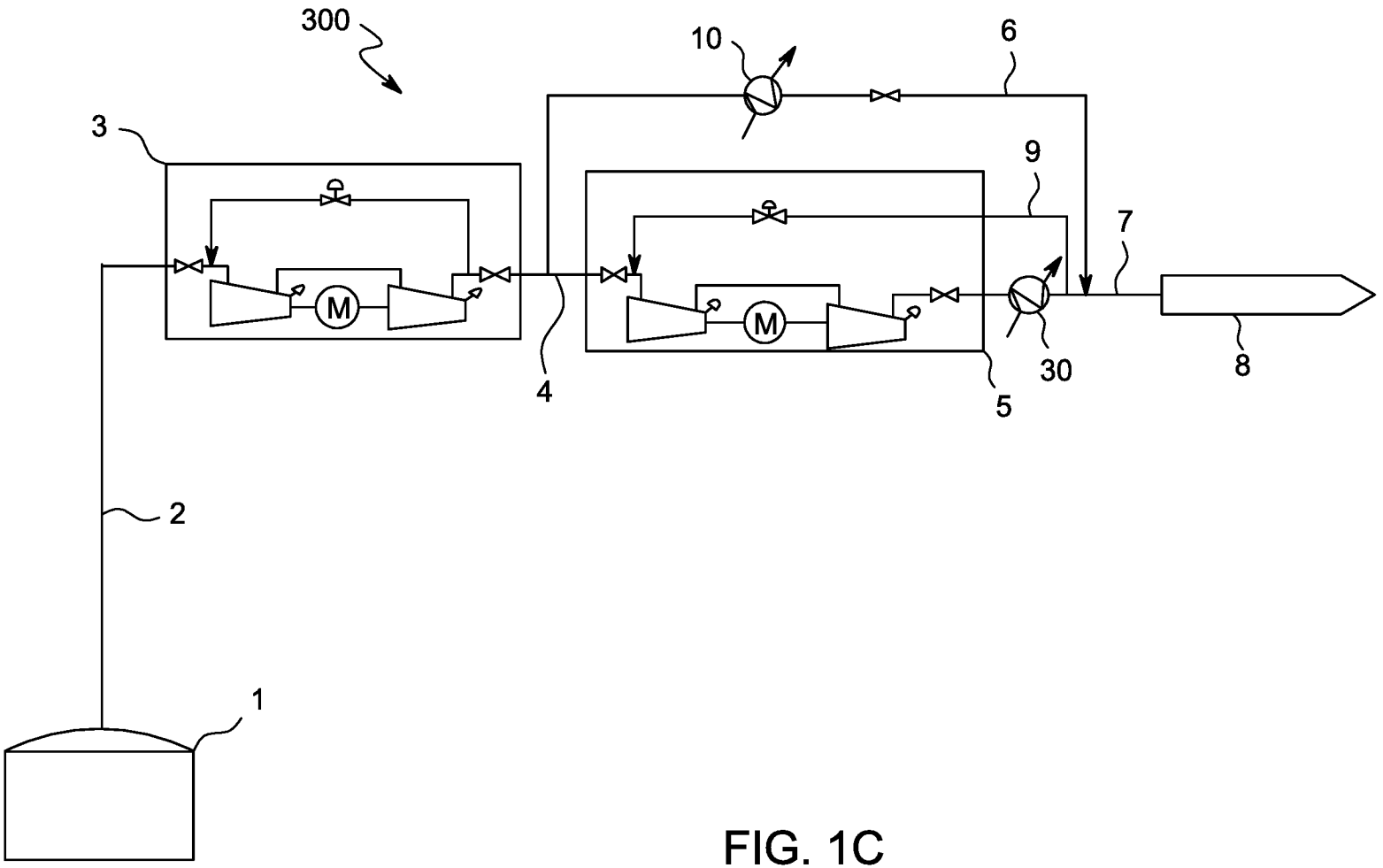
Figure 1D:
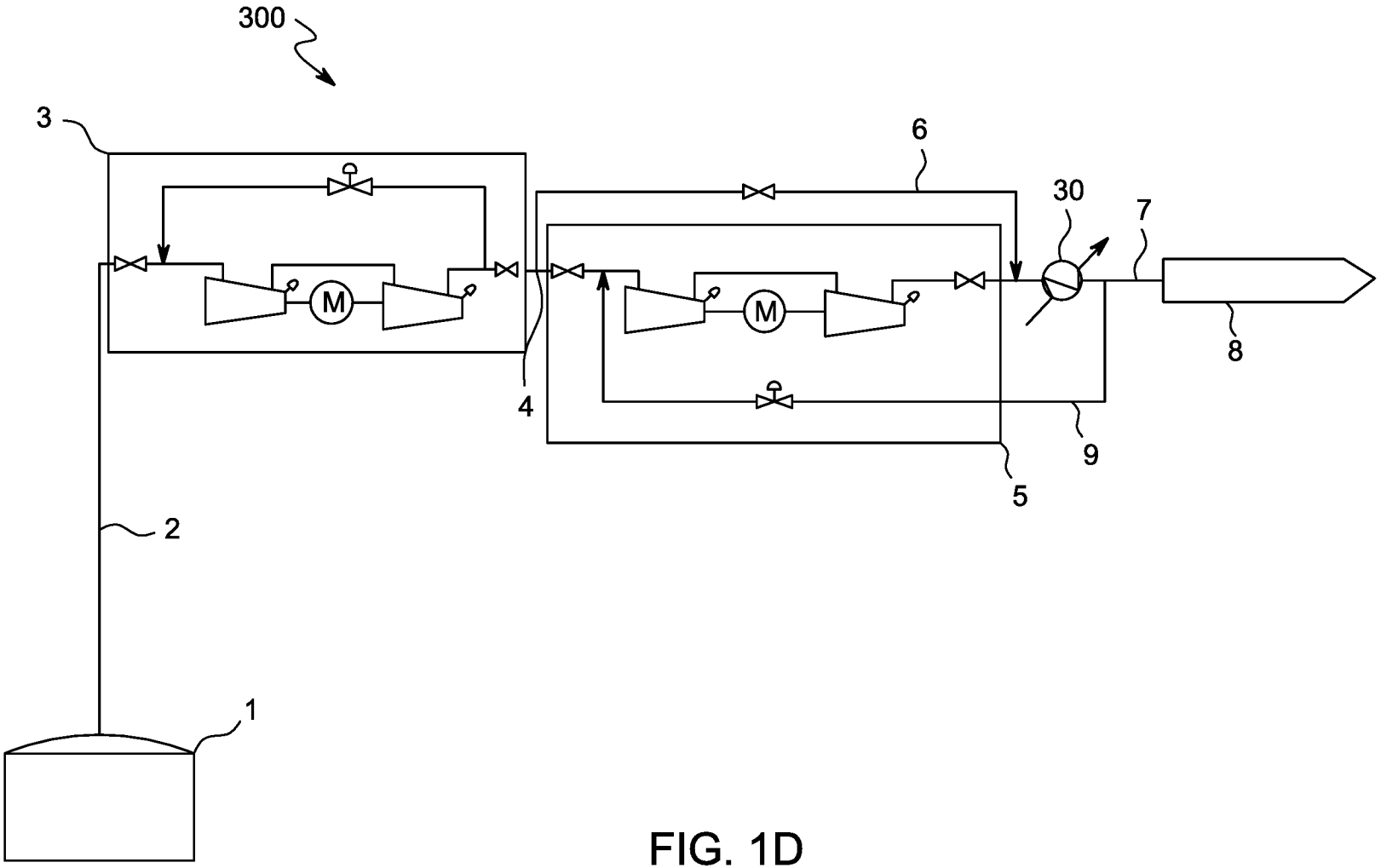

FIG. 1D shows another embodiment which is essentially based on the embodiment of FIG. 10. However, the bypass line 6 in this embodiment ends in the header 7 upstream the fourth cooling unit 30. By this arrangement, there is no need for cooling unit 10 in the bypass line 6 as gas bypassing the second compressor module 5 is conveyed to the cooling unit 30 and can thus be cooled before reaching the consumer 8. On the other hand, gas which is conveyed through both compressor modules 3 and 5, can also be cooled by the cooling unit 30 before reaching the consumer 8. Regarding the antisurge line 9 the same statements apply as made in connection with FIG. 1C.

Figure 1E:
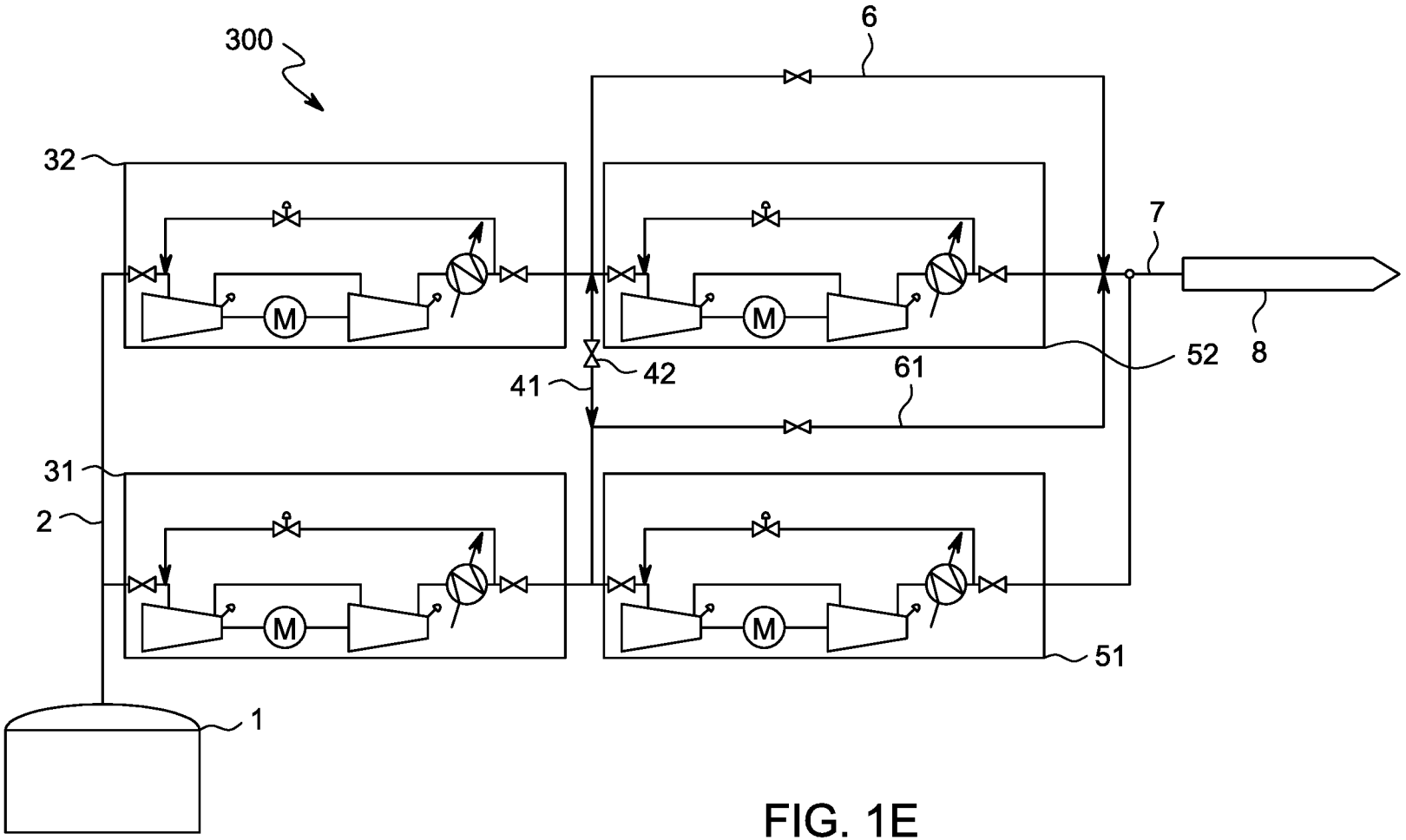

FIG. 1E schematically shows another embodiment of a compressor arrangement 300 which comprises two parallel trains of compressor modules, the compressor modules of a train being in series while the compressor modules in a train are arranged parallel to the compressor modules in the parallel train. In this embodiment, the first train comprises two compressor modules 32 and 52 connected in series, the second parallel train also comprises two compressor modules 31 and 51 connected in series. In this embodiment each of the compressor modules 31, 32, 51, 52 is a 2-stage compressor. Also other one or multi-stage compressor modules can be used. In general, one of the two trains can be operated, while the other train is in spare. However, with the modular approach of the present compressor arrangement, an operation becomes possible where the first compressor module of one train feeds the second compressor module of the other train. This is achieved by the crossover-line 41 equipped with an isolation or shut-off device such as a manual valve 42. With such an arrangement it is possible to conduct pressurized gas from compressor module 32 through crossover-line 41 to compressor module 51 of the second train and supplying the consumer 8 with pressurized gas from compressor module 51. Such an operation bypasses compressor modules 31 and 52, which can then be deactivated. Alternatively, pressurized gas from compressor module 31 can be conveyed through crossover-line 41 to compressor module 52 and then supplied to consumer 8. In this case, the bypassed compressors 32 and 51 can be deactivated.

It should be noted that with the arrangement shown in FIG. 1E, it is also possible to deliver pressurized gas to a consumer 8, which gas is only pressurized by one of the compressor modules 31 or 32. This is made possible by bypass lines 6 and 61 respectively. For example, compressed gas from compressor module 31 can be sent through bypass line 61 to header 7 if valve 42 is closed. In the same way, gas from compressor module 32 can be conducted through bypass line 6 to header 7 if valve 42 is closed.

The arrangement shown in FIG. 1E provides a very flexible operation depending on the consumers' needs. It is also possible to operate both trains simultaneously to increase the mass flow to consumer 8. This is achieved by closing bypass lines 61 and 6 as well as crossover-line 41.

Figure 2A:
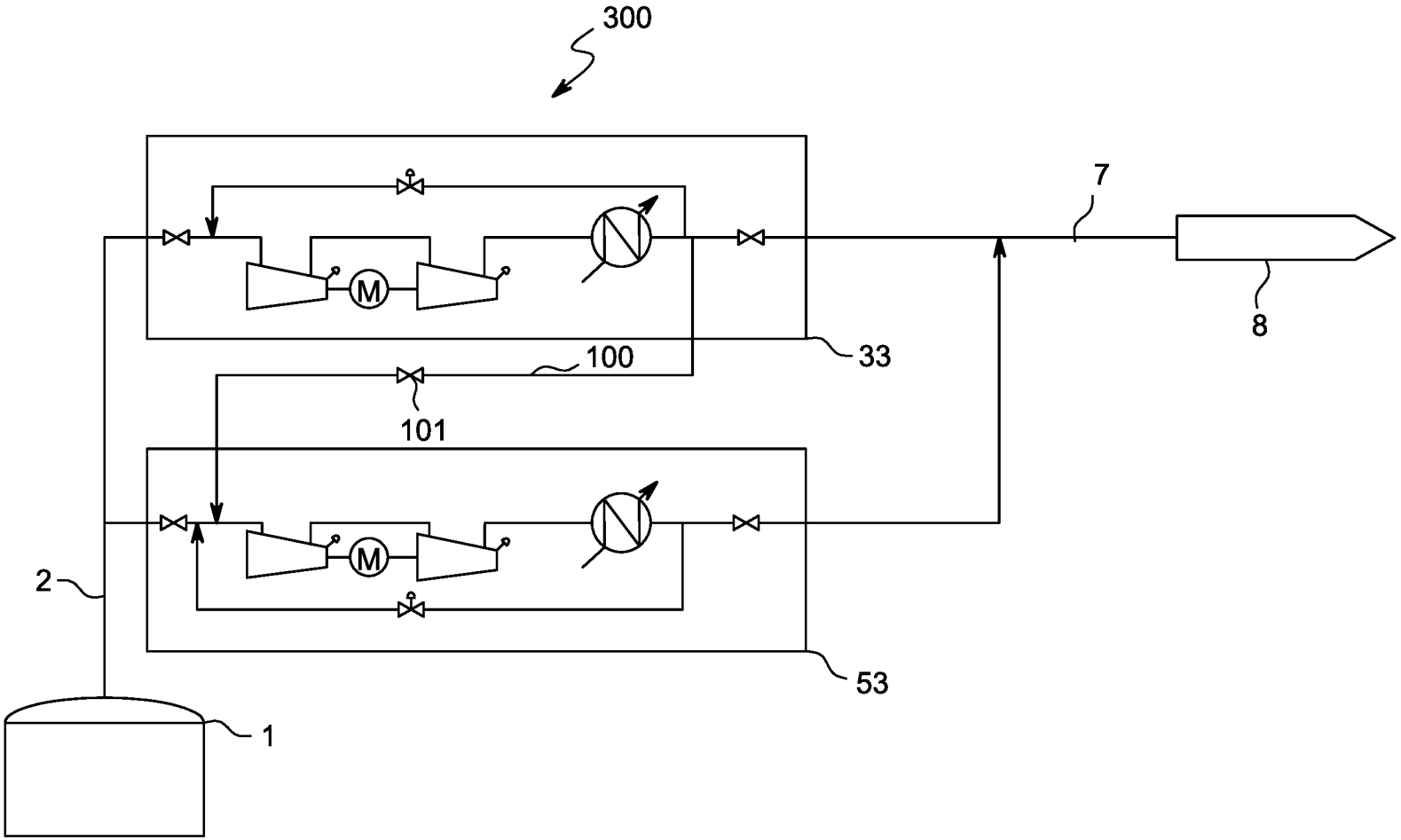

FIG. 2A shows yet another embodiment of a compressor arrangement 300 comprising two parallel trains, each train only comprising one compressor module, i. e. two compressor modules 33 and 53 are arranged in parallel. Parallel compressor modules are generally used to feed fuel gas consumers with cold and rather high pressure BOG, one compressor module being in operation, the other one in spare. In some BOG conditions, however, one single compressor module may struggle to maintain the required fuel gas pressure. To overcome this disadvantage, the embodiment of FIG. 2A provides a crossover-line 100 having a valve 101, the crossover-line 100 connecting an exit of compressor module 33 with an inlet of compressor module 53 such that the two parallel compressor modules 33 and 53 can be operated in series by means of the crossover-line 100 in its open state. Thus, in case one single compressor module is not able to maintain the required fuel gas pressure, both compressor modules 33 and 53 can be connected in series by opening the valve 101 in crossover-line 100 in order to increase the stage number used for fuel gas compression.

Even if the modular approach according to the present invention could be applied to different types of compressors, magnetic bearing compressors equipped with VDV (Variable Diffusor Vanes), and VFD (Variable Frequency Drive)

would provide the best flexible and the most efficient solution since the whole machine speed range is available (as opposed to integrally geared machines). It allows the efficiency optimization of the operating point for each compressor stage. Thanks to VFD and VDV, the downstream compressor module can adapt to the new suction conditions equivalent to the first compressor module discharge (typically medium pressure level, 40° C.) to provide fuel gas to the consumer 8 at the required pressure.

Figure 2B:
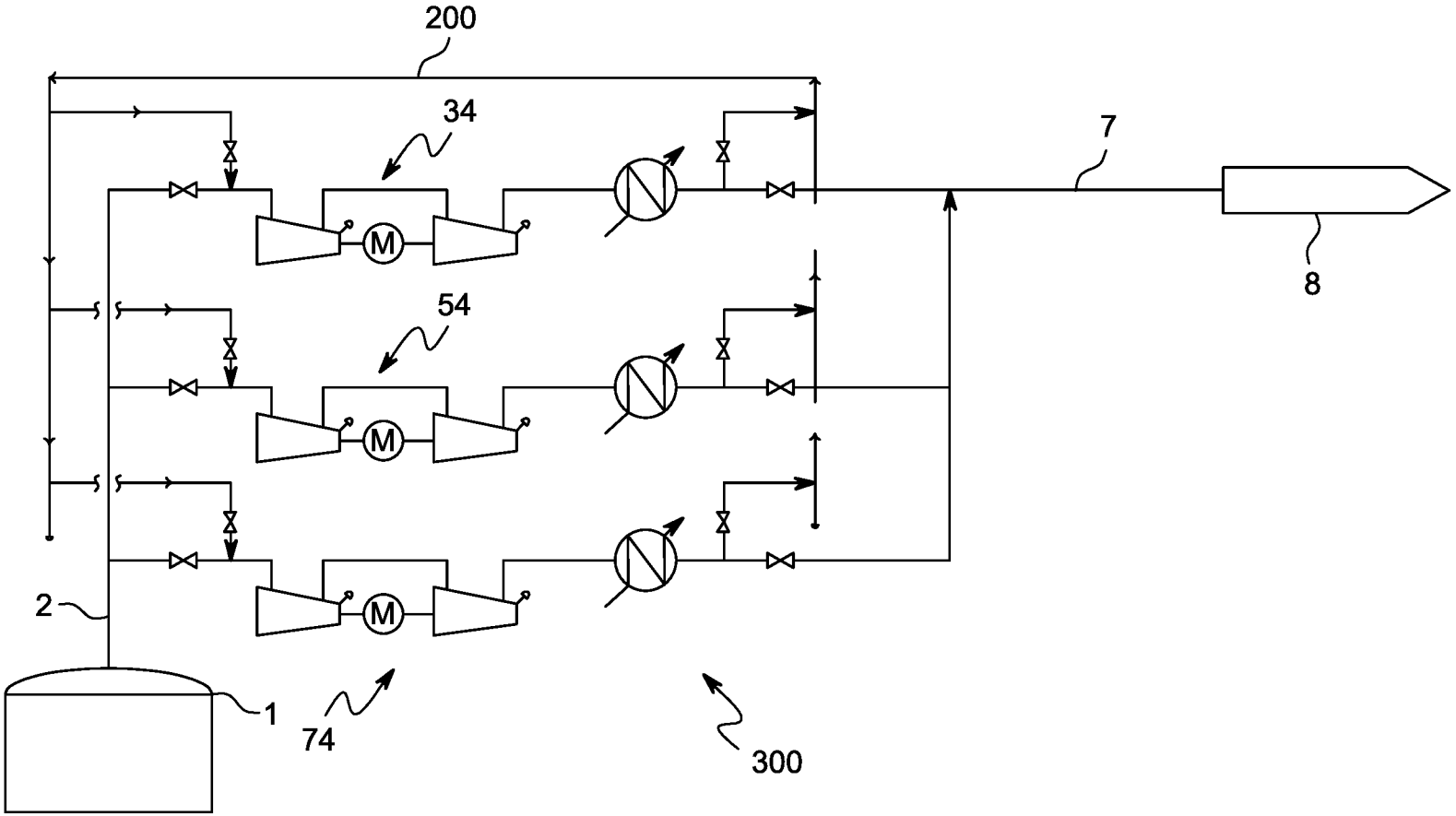

FIG. 2B shows another embodiment which is essentially based on the embodiment of FIG. 2A. In this embodiment three identical compressor modules 34, 54, 74 are arranged in parallel, each being fed by the main input line 2 from tank 1. Each compressor module can be interconnected in series with any of the other two compressor modules. This is achieved by installing a header 200 connecting all the module discharge sides to all the module suction sides. Additional valves are required to interconnect in series two modules out of three. The remaining one can be considered as a spare and deactivated. In the arrangement shown in FIG. 2B any one of the compressor modules 34, 54 or 74 can be operated alone and feed pressurized gas to the consumer 8. In this case, no gas is conveyed through header 200. Furthermore, two out of the three modules can be operated in series. Finally, all compressor modules 34, 54 and 74 can be operated in series in order to achieve higher pressures of the fuel gas to be supplied to the consumer 8. On the other hand, high mass flow or load requirements can be fulfilled by operating two or three of the modules 34, 54 and 74 in parallel.

Figure 3:
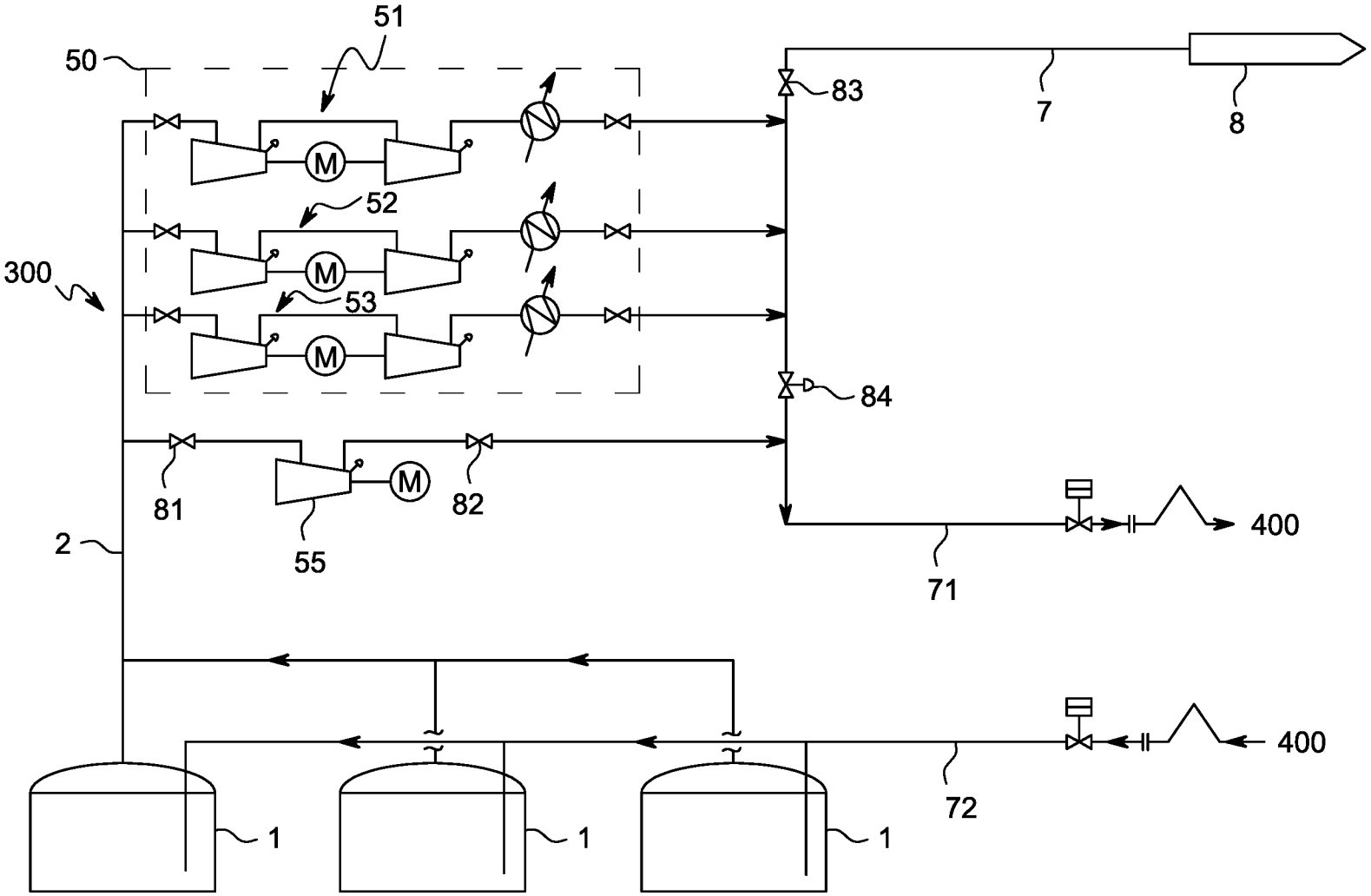

FIG. 3 shows another embodiment of a compressor arrangement 300 comprising two parallel trains, first train being a compressor group 50 comprising three compressor modules 51, 52, 53 arranged in parallel, the second train comprising one single compressor module 55. Such an arrangement is especially useful during LNG carrier loading operations where LNG is sent from an exporting terminal 400 to carrier storage tanks 1. Due to tank cool-down and in-tank piston effect, the tank filling creates a high quantity of BOG which is usually sent back to the terminal 400. This is achieved by a high duty compressor 55 with high volume flow and low head capability. Compressor suction is connected to the tanks 1 whereas compressor discharge is connected to shore thanks to a dedicated vapour header 71 and loading arm. Due to sparing requirement, two high duty compressors are installed. Loading compressors 51, 52 and 53 of compressor group 50 are not required and therefore their combined capacities can be considered as a spare to the high duty compressor 55. Fuel gas compressors 51, 52 and 53 can all be run in parallel and their discharge flow can be routed to the vapour header 71 via valve 84 and isolated from fuel gas header 7 by closing the valve 83. Due to fuel gas compressor characteristics, valve 84 would be required to maintain a minimum fuel gas compressor backpressure. Valves 81 and 82 are provided to operate the high duty compressor 55.

LIST OF REFERENCE SIGNS

1 tank, source of liquefied gas
2 main input line
3 (first) compressor module
4 interconnecting line
5 (second) compressor module
6 bypass line
7 header, consumer line
8 consumer
9 antisurge line
10 first cooling unit
third cooling unit
30 fourth cooling unit
31, 32, 33 compressor module
51, 52, 53 compressor module
34, 54, 74 compressor module
41 crossover-line
42 valve
50 compressor group
51, 52, 53 compressor module
55 compressor module
61 bypass line
71 vapour header
72 loading header
81, 82, 83, 84 valve
100 crossover-line
101 valve
200 header
300 compressor arrangement
400 terminal

The invention claimed is:

1. A method for providing pressurized gas from a source of liquefied gas (1) to a consumer (8), said method comprising:

supplying a vaporized gas from the source of liquefied gas (1) through a main input line (2) to a compressor arrangement (300) for pressurizing the vaporized gas, the compressor arrangement (300) comprising a plurality of compressor modules (3, 5, 31, 51), each compressor module being able to operate independently from any other compressor module of the compressor arrangement (300), and said compressor arrangement (300) having the ability to bypass one or more of the plurality of compressor modules (5, 51) of the compressor arrangement (300), wherein gas is conducted through only a part or all of the compressor modules depending on at least one of pressure level, temperature level, mass flow and composition of the gas to be provided to the consumer (8), and wherein pressurized vaporized gas is cooled by conducting the pressurized vaporized gas through a first cooling unit (10) in a bypass line (6) bypassing the one or more of the plurality of compressor modules (5).

2. The method of claim 1, wherein at least a part of the compressor modules is connected in series and wherein one or more of bypassed compressor modules (5, 32, 51) are deactivated.

3. The method of claim 1, wherein a first compressor module (31) and a second compressor module (52) of the plurality of compressor modules are arranged in parallel and connected via a crossover-line (41), having a shut-off valve, and which connects an outlet of the first compressor module (31) with an inlet of the second compressor module (52), and wherein gas is conducted through the first and the second compressor modules (31, 52) connected in series when the shut-off valve of the crossover-line (41) is in an open state.

4. The method of claim 3, wherein the first compressor module (31) is operated as a compressor module in a train of at least two compressor modules (31, 51) connected in series, and/or the second compressor module (52) is operated as a compressor module in a train of at least two compressor modules (32, 52) connected in series.

5. The method of claim 1, wherein boil-off gas from the source of liquefied gas (1) is used as the vaporized gas.

6. The method of claim 1, wherein pressurized vaporized gas is cooled by conducting the pressurized vaporized gas through a cooling unit arranged at the inlet and/or a another cooling unit (20) arranged at the outlet of a compressor module (5).

7. The method of claim 1, wherein at least a part of the pressurized vaporized gas discharged from a compressor module (5) of the plurality of compressor modules is returned to an inlet of said compressor module (5) via an antisurge line (9).

8. The method of claim 7, wherein, before returning the pressurized vaporized gas to the inlet of said compressor module (5) via antisurge line (9), the gas is cooled by a further cooling unit (30) at the outlet of said compressor module (5).

9. The method of claim 8, wherein bypassed gas is cooled by the further cooling unit (30) after having bypassed said compressor module (5).

10. A compressor arrangement for providing pressurized gas from a source of liquefied gas to a consumer (8), comprising:

a main input line (2) for supplying vaporized gas from the source of liquefied gas (1) to a compressor arrangement (300) for pressurizing the vaporized gas, the compressor arrangement (300) comprising:

a plurality of compressor modules (3, 5, 31, 51), each compressor module being able to operate independently from any other compressor module of the compressor arrangement (300), and a bypass line (6) for bypassing one or more of the plurality of compressor modules of the compressor arrangement (300) such that gas is conducted through only a part or all of the compressor modules of the compressor arrangement (300) and supplied to the consumer (8) via a consumer line (7), wherein said bypass line (6) includes a first cooling unit (10).

11. The compressor arrangement of claim 10, wherein the compressor arrangement (300) comprises at least two compressor modules (3, 5) connected in series by interconnection lines (4), wherein said bypass line (6) branches off upstream an inlet of one of the plurality of compressor modules (5) and reconnects downstream an outlet of this or another compressor module, the bypass line (6) having a shut-off device to be operated depending on at least one of pressure level, temperature level, mass flow and composition of the gas to be provided to the consumer (8).

12. The compressor arrangement of claim 10, wherein the compressor arrangement (300) comprises at least two parallel trains of compressor modules, each train being connectable to the main input line (2), each train comprising one or more compressor modules, wherein an outlet of one compressor module (31, 33) of one of the at least two parallel trains is connected with an inlet of another compressor module (52, 53) of another train of the at least two parallel trains via a crossover-line (41, 100), the crossover-line having a shut-off device (42, 101) to be operated depending on at least one of pressure level, temperature level, mass flow and composition of the gas to be provided to the consumer (8).

13. The compressor arrangement of claim 11, wherein the bypass line (6) reconnects to the consumer line (7) upstream of a cooling unit (30).

14. The compressor arrangement of claim 10, wherein a compressor module (5) of the compressor arrangement (300) comprises at least a part of an antisurge line (9) for returning at least a part of the pressurized gas of the compressor module (5) to an inlet of this compressor module (5), a cooling unit (30) being arranged at the outlet of the compressor module (5), and an inlet of the antisurge line (9) being located downstream of the cooling unit (30) such that the inlet of the antisurge line (9) is located outside of the compressor module (5).

15. The method of claim 1, wherein pressurized vaporized gas is cooled by conducting the pressurized vaporized gas through a second cooling unit arranged at the inlet and/or a third cooling unit (20) arranged at the outlet of a compressor module (5) of the plurality of compressor modules.

16. The method of claim 15, wherein at least a part of the pressurized vaporized gas of discharged from said compressor module (5) is returned to an inlet of said compressor module (5) via an antisurge line (9).

17. The method of claim 16, wherein, before returning the gas to the inlet of said compressor module (5), the gas is cooled by a fourth cooling unit (30) at the outlet of said compressor module (5).

18. The method of claim 17, wherein bypassed gas is cooled by the fourth cooling unit (30) after having bypassed said compressor module (5).

19. The method of claim 3, wherein the first compressor module (31) is operated as a compressor module in a train of at least two compressor modules (31, 51) connected in series.

20. The method of claim 3, wherein the second compressor module (52) is operated as a compressor module in a train of at least two compressor modules (32, 52) connected in series.

21. The method of claim 7, wherein, downstream of the antisurge line (9), the gas is cooled by a further cooling unit (30) at the outlet of said compressor module (5).

22. The method of claim 21, wherein bypassed gas is cooled by the further cooling unit (30) after having bypassed said compressor module (5).

23. The compressor arrangement of claim 11, wherein the bypass line (6) reconnects to the consumer line (7) downstream of a cooling unit (30), and wherein the compressor arrangement (300) comprises at least a part of an antisurge line (9) for returning at least a part of the pressurized gas discharged from said one of the plurality of compressor modules (5) to an inlet of said one of the plurality of compressor modules (5), and said at least a part of the antisurge line (9) connects with the consumer line (7) upstream of a cooling unit (30).

* * * * *